US006598501B1

(12) United States Patent
Schulze-Beckinghausen et al.

(10) Patent No.: US 6,598,501 B1
(45) Date of Patent: Jul. 29, 2003

(54) APPARATUS AND A METHOD FOR FACILITATING THE CONNECTION OF PIPES

(75) Inventors: Joerg Eric Schulze-Beckinghausen, Garbsen (DE); Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/890,194

(22) PCT Filed: Dec. 23, 1999

(86) PCT No.: PCT/GB99/04393

§ 371 (c)(1),
(2), (4) Date: Jul. 26, 2001

(87) PCT Pub. No.: WO00/45026

PCT Pub. Date: Aug. 3, 2000

(30) Foreign Application Priority Data

Jan. 28, 1999 (GB) ..... 9901778

(51) Int. Cl.[7] ..... B25B 17/00
(52) U.S. Cl. ..... 81/57.15; 81/57.21; 81/57.34
(58) Field of Search ..... 81/57.15, 57.19, 81/57.21, 57.33, 57.34

(56) References Cited

U.S. PATENT DOCUMENTS

| | | | | |
|---|---|---|---|---|
| 1,386,908 A | | 8/1921 | Taylor | |
| 1,842,638 A | | 1/1932 | Wigle | |
| 2,214,194 A | | 9/1940 | Frankley | 251/84 |
| 2,214,429 A | | 9/1940 | Miller | 166/16 |
| 2,522,444 A | | 9/1950 | Grable | 166/16 |
| 2,610,690 A | | 9/1952 | Beatty | 166/16 |
| 2,950,639 A | | 8/1960 | Mason | 81/53 |
| 3,021,739 A | | 2/1962 | Grundmann | 81/53 |
| 3,041,901 A | | 7/1962 | Knights | 81/53 |
| 3,086,413 A | | 4/1963 | Mason | 81/53 |
| 3,122,811 A | | 3/1964 | Gilreath | 24/263 |
| 3,131,586 A | | 5/1964 | Wilson | 81/52.4 |
| 3,180,186 A | | 4/1965 | Catland | 81/57 |
| 3,220,245 A | | 11/1965 | Van Winkle | 73/46 |
| 3,302,496 A | | 2/1967 | Mitchell et al. | 81/53 |
| 3,349,455 A | | 10/1967 | Doherty | 24/263 |
| 3,443,291 A | | 5/1969 | Doherty | 24/263 |
| 3,475,038 A | | 10/1969 | Matherne | 285/27 |
| 3,518,903 A | | 7/1970 | Ham et al. | 81/57.16 |
| 3,559,739 A | | 2/1971 | Hutchison | 166/311 |
| 3,680,412 A | * | 8/1972 | Mayer et al. | 81/57.34 |
| 3,722,331 A | | 3/1973 | Radulescu | 81/52.4 |
| 3,747,675 A | | 7/1973 | Brown | 166/237 |
| 3,796,418 A | * | 3/1974 | Carlberg | 269/26 |
| 3,808,916 A | | 5/1974 | Porter et al. | 81/57.19 |
| 3,838,613 A | | 10/1974 | Wilms | 81/57.34 |
| 3,933,108 A | | 1/1976 | Baugh | |
| 3,941,348 A | | 3/1976 | Mott | 251/58 |
| 3,986,564 A | | 10/1976 | Bender | 173/4 |
| 4,005,621 A | | 2/1977 | Turner, Jr. et al. | 81/57.2 |
| 4,142,739 A | | 3/1979 | Billingsley | 285/18 |

(List continued on next page.)

FOREIGN PATENT DOCUMENTS

| | | | |
|---|---|---|---|
| DE | 2 128 362 | 1/1972 | E21B/19/00 |
| EP | 0 285 386 | 10/1988 | E21B/19/16 |
| EP | 0 311 455 | 4/1989 | E21B/19/16 |
| EP | 0339005 | 10/1989 | E21B/19/16 |
| EP | 0 423 055 A2 | 4/1991 | E21B/17/043 |
| EP | 0 525 247 A1 | 2/1993 | E21B/3/02 |
| GB | 1215967 | 12/1970 | B25B/13/50 |

(List continued on next page.)

*Primary Examiner*—Joseph J. Hail, III
*Assistant Examiner*—David B. Thomas
(74) *Attorney, Agent, or Firm*—Moser, Patterson & Sheridan, L.L.P.

(57) ABSTRACT

An apparatus for facilitating the connection of pipes which apparatus comprises a rotary (1) and jaws (20, 21, 22), characterised in that all of said jaws (20, 21, 22) are active and are actuable by pressurised fluid.

21 Claims, 2 Drawing Sheets

U.S. PATENT DOCUMENTS

Figure 1:
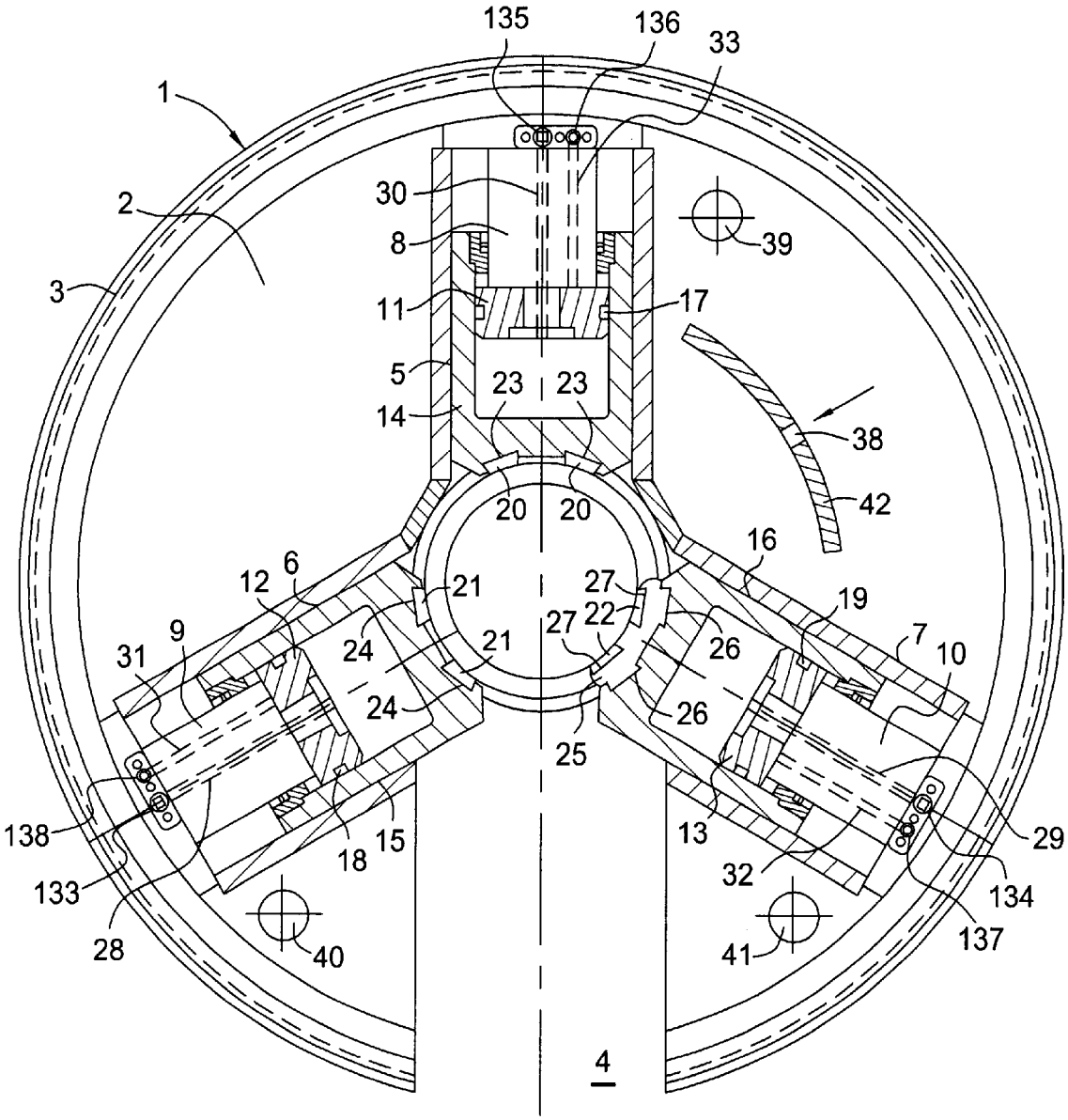

| | | | | | |
|---|---|---|---|---|---|
| 4,159,637 | A | | 7/1979 | Lamb et al. | 73/46 |
| 4,170,908 | A | | 10/1979 | Peveto et al. | 81/57.11 |
| 4,221,269 | A | | 9/1980 | Hudson | 173/163 |
| 4,246,809 | A | | 1/1981 | Keast et al. | 81/57.16 |
| 4,257,442 | A | | 3/1981 | Claycomb | 137/238 |
| 4,262,693 | A | | 4/1981 | Giebeler | 137/494 |
| 4,291,762 | A | | 9/1981 | Gudgel | 166/85 |
| 4,295,527 | A | | 10/1981 | Russe | 166/315 |
| 4,315,553 | A | | 2/1982 | Stallings | 175/207 |
| 4,334,444 | A | * | 6/1982 | Carstensen et al. | 81/57.18 |
| 4,346,629 | A | | 8/1982 | Kinzbach | 81/57.2 |
| 4,401,000 | A | | 8/1983 | Kinzbach | 81/57.2 |
| 4,402,239 | A | * | 9/1983 | Mooney | 81/57.16 |
| 4,442,892 | A | | 4/1984 | Delesandri | 166/85 |
| RE31,699 | E | | 10/1984 | Eckel | 73/862.25 |
| 4,492,134 | A | | 1/1985 | Reinholdt et al. | 81/57.34 |
| 4,499,919 | A | | 2/1985 | Forester | 137/613 |
| 4,565,003 | A | | 1/1986 | McLeod | 29/281.1 |
| 4,573,359 | A | | 3/1986 | Carstensen | 73/761 |
| 4,593,773 | A | | 6/1986 | Skeie | 175/85 |
| 4,643,259 | A | | 2/1987 | Zeringue, Jr. | 166/77.5 |
| 4,649,777 | A | * | 3/1987 | Buck | 81/57.19 |
| 4,709,766 | A | | 12/1987 | Boyadjieff | 175/52 |
| 4,712,284 | A | | 12/1987 | Coyle et al. | 29/240 |
| 4,715,625 | A | | 12/1987 | Shows, Jr. et al. | 285/145 |
| 4,773,218 | A | | 9/1988 | Wakita et al. | 60/476 |
| 4,811,635 | A | | 3/1989 | Falgout, Sr. | 81/57.33 |
| 4,938,109 | A | | 7/1990 | Torres et al. | 81/467 |
| 4,979,356 | A | * | 12/1990 | Vatne | 81/57.16 |
| 5,000,065 | A | * | 3/1991 | Haynes | 81/57.2 |
| 5,022,472 | A | | 6/1991 | Bailey et al. | 175/195 |
| 5,044,232 | A | | 9/1991 | Schulze-Beckinghausen | 81/57.18 |
| 5,092,399 | A | | 3/1992 | Lang | 166/77.5 |
| 5,150,642 | A | | 9/1992 | Moody et al. | 81/57.2 |
| 5,159,860 | A | * | 11/1992 | Pietras | 81/57.19 |
| 5,161,438 | A | | 11/1992 | Pietras | 81/57.16 |
| 5,167,173 | A | | 12/1992 | Pietras | 81/57.15 |
| 5,209,302 | A | | 5/1993 | Robichaux et al. | 166/355 |
| 5,221,099 | A | | 6/1993 | Jansch | 279/151 |
| 5,259,275 | A | | 11/1993 | Schulze-Beckinghausen | 81/57.16 |
| 5,297,833 | A | | 3/1994 | Willis et al. | 294/102.2 |
| 5,390,568 | A | | 2/1995 | Pietras | 81/57.16 |
| 5,451,084 | A | | 9/1995 | Jansch | 294/1.1 |
| 5,520,072 | A | | 5/1996 | Perry | 81/57.16 |
| 5,634,671 | A | | 6/1997 | Watkins | 285/18 |
| 5,706,893 | A | | 1/1998 | Morgan | 166/86.1 |
| 5,730,471 | A | | 3/1998 | Schulze-Beckinghausen et al. | 285/18 |
| 5,746,276 | A | | 5/1998 | Stuart | 173/1 |
| 5,787,982 | A | | 8/1998 | Bakke | 166/242.6 |
| 5,819,605 | A | | 10/1998 | Buck et al. | 81/57.33 |
| 5,839,330 | A | | 11/1998 | Stokka | 81/57.33 |
| 5,842,390 | A | | 12/1998 | Bouligny et al. | 81/57.34 |
| 5,845,549 | A | | 12/1998 | Bouligny | 81/57.33 |
| 5,890,549 | A | | 4/1999 | Sprehe | 175/71 |
| 5,992,801 | A | | 11/1999 | Torres | 248/49 |
| 6,065,372 | A | | 5/2000 | Rauch | 81/57.15 |
| 6,082,224 | A | | 7/2000 | McDaniels et al. | 81/57.15 |
| 6,082,225 | A | * | 7/2000 | Richardson | 81/57.16 |
| 6,119,772 | A | | 9/2000 | Pruet | 166/81.1 |
| 6,138,529 | A | | 10/2000 | Pietras | 81/57.33 |
| 6,161,617 | A | | 12/2000 | Gjedebo | 166/77.52 |
| 6,206,096 | B1 | | 3/2001 | Belik | 166/77.51 |
| 6,223,629 | B1 | * | 5/2001 | Bangert | 81/57.15 |
| 6,305,720 | B1 | | 10/2001 | Spiering et al. | 285/18 |
| 6,327,938 | B1 | | 12/2001 | Pietras | 81/57.33 |
| 6,330,911 | B1 | | 12/2001 | Allen et al. | 166/77.51 |
| 6,360,911 | B1 | | 3/2002 | Arnold | 220/571 |
| 6,412,554 | B1 | | 7/2002 | Allen et al. | 166/80.1 |
| 6,480,811 | B2 | | 11/2002 | Denny et al. | 702/188 |

FOREIGN PATENT DOCUMENTS

| | | | | |
|---|---|---|---|---|
| GB | 2049518 | | 12/1980 | E21B/19/16 |
| GB | 2128526 | | 9/1982 | E21B/19/16 |
| GB | 2 300 896 | | 11/1996 | F16K/3/08 |
| GB | 2346576 | | 8/2000 | E21B/19/16 |
| GB | 2346577 | | 8/2000 | E21B/19/16 |
| WO | WO 83/03443 | | 10/1983 | E21B/19/16 |
| WO | 92/18744 | | 10/1992 | E21B/19/16 |
| WO | WO 93/18276 | | 9/1993 | E21B/19/16 |
| WO | WO 95/20471 | | 8/1995 | B25B/17/00 |
| WO | WO 98/16716 | | 4/1998 | E21B/21/00 |
| WO | WO 98/32948 | | 7/1998 | E21B/19/16 |
| WO | WO 99/34089 | | 7/1999 | E21B/19/16 |
| WO | WO 99/34090 | | 7/1999 | E21B/21/00 |
| WO | WO 99/34091 | | 7/1999 | E21B/21/00 |
| WO | WO 00/22278 | | 4/2000 | E21B/19/16 |
| WO | WO 00/23686 | | 4/2000 | E21B/19/16 |
| WO | WO 00/45026 | | 8/2000 | E21B/19/16 |
| WO | WO 00/45027 | | 8/2000 | E21B/19/16 |
| WO | WO 00/79092 | A2 | 12/2000 | E21B/21/08 |
| WO | WO 01/03889 | A1 | 1/2001 | B25B/17/00 |
| WO | WO 01/09479 | | 2/2001 | E21B/19/16 |
| WO | WO 01/38688 | | 5/2001 | E21B/19/16 |
| WO | WO 01/66905 | A2 | 9/2001 | E21B/19/16 |

* cited by examiner 200
100
138
148
139
147
137
149
143
142
ST3
ST2
ST1
146
141
136
145
144
140
150
151
117
16
135
Z3
7
13
134
131a
6
12
15
Z2
133
Z1
5
11
14
128
127
Sp1
4.01
109
130
θ1.5
θ0.5
153
152
122
123
119
124
126
129
121
2.01
Sp2
X
125
120
155
157
SAFETY RELEASE ACCUMULATOR
P2
116
156
132
131
114
LOAD ACCUMULATOR
41
40
AIR
101
102
103
104
115
38
COUPLER TO ROTOR
105
112
118
108
106
113
107
111
110
39

APPARATUS AND A METHOD FOR FACILITATING THE CONNECTION OF PIPES

This invention relates to an apparatus and a method for facilitating the connection of pipes, and more particularly, but not exclusively, to a powered drill pipe tong for facilitating the connection of sections or stands of drill pipe.

Drill pipe tongs are commonly used for facilitating the connection of sections or stands of drill pipe to a pipe string. Typically, the pipe string hangs in a wellbore from a spider in a floor of an oil or gas rig.

A section or stand of drill pipe to be connected to the pipe string is swung in from a drill pipe rack to the well centre above the pipe string. A pipe handling arm may be used to guide the drill pipe to a position above the pipe string. A stabbing guide may then be used to align a threaded pin of the drill pipe with a threaded box of the pipe string. A drill pipe tong is then used to tighten the connection to a torque of typically 68,000 Nm (50,000 lb.ft).

The drill pipe tong is also used for disconnecting drill pipe. This operation involves breaking the connection which requires a torque typically greater than the tightening torque which may typically be in the order of 110,000 Nm (80,000 lb.ft).

A drill pipe tong generally comprises jaws mounted in a rotary which is rotatably arranged in a housing. The jaws are moveable relative to the rotary in a generally radial direction towards and away from an upset part of the pipe to be gripped. The upset parts of the pipe are generally located above the pin and below the box of the pipe and have an enlarged outer diameter and/or a reduced inner diameter.

In use, the rotary is rotated forcing the jaws along cam surfaces towards the upset part of the section of pipe. Once the jaws fully engage the upset part, the rotary carries on rotating applying torque to the threads and hence tightens the connection between the section of pipe and the pipe string.

Several problems have been observed with such prior art drill pipe tongs.

In particular, such drill pipe tongs can badly scar the upset part of the pipe, particularly if the jaws start rotating relative to the drill pipe.

Once scarred, the pipe is then lowered into the wellbore. Friction between the wellbore (or casing lining the wellbore) and the scarred upset grinds the upset, reducing the diameter.

Scarring of the upset may also be caused by having to reapply the jaws. This is especially common when connecting pipe with "wedge threads" which requires approximately 80° of turn in order to toque the connection. Many prior art wrenching tongs need to be reapplied to the pipe every 25°.

A reduction in diameter of the upset requires the use of a new drill pipe tong or for the old drill pipe tong to be modified therefor.

An attempt at solving this problem is disclosed in PCT Publication Number WO 92/18744, which discloses a rotary comprising hydraulically operated active jaws and stationary passive jaws. The hydraulically activated jaws are engaged fully with the pipe prior to rotation of the rotary, thereby substantially reducing scarring. A hydraulic circuit is provided on the rotary for actuating the jaws. A plunger is used to activate the hydraulic system by depressing a hydraulic piston of the hydraulic circuit repeatedly. This operation takes time, If several seconds can be saved per connection, the overall cost of the construction of an oil or gas well can be drastically reduced, as long as reliability is not sacrificed. Another problem associated with the rotary disclosed in PCT Publication Number WO 92/18744 is that repeated depressing of the plunger for engaging the jaws fully with the pipe may itself cause some scaring.

The present invention provides an apparatus for facilitating the connection of pipes which apparatus comprises a rotary and jaws, characterised in that all of said jaws are active and are actuable by pressurised fluid.

Other aspects of the invention are set out in claims 2 to 14.

There is also provided a method for facilitating the connection of pipes, the method comprising the steps of actuating the jaws of an apparatus in accordance with the present invention with pressurised fluid so that the jaws engage with a pipe at a central axis of the rotary thereof, rotating said pipe to a predetermined torque, and disengaging said jaws, preferably with said pressurised fluid.

Figure 2:
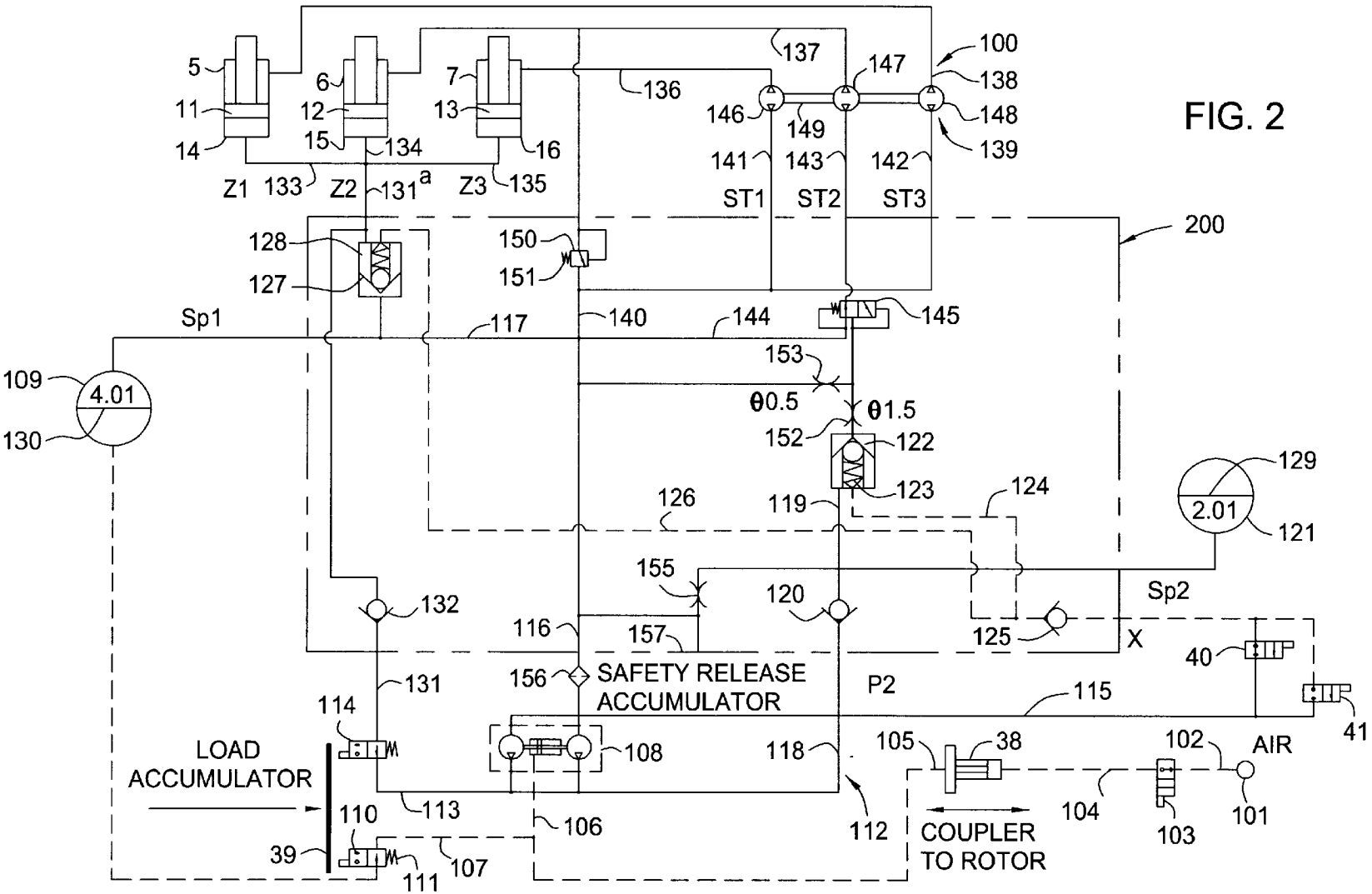

For a better understanding of the invention, reference will now be made, by way of example, to the accompanying drawings, in which:

FIG. 1 is a top plan view of a rotary of a drill pipe tong in accordance with the invention with parts shown in cross-section; and FIG. 2 is a schematic of a part hydraulic, part pneumatic circuit used in the rotary of FIG. 1.

Referring to FIG. 1 there is shown a rotary which is generally identified by reference numeral 1.

The rotary 1 comprises a rigid housing 2 which is provided with a toothed ring 3 for engagement with toothed drive wheels in a stator of the drill pipe tong (not shown). The housing 2 is also provided with an opening 4 for receiving a drill pipe.

Three piston and cylinders 5, 6 and 7 are arranged about the rotary 1 spaced at 120° to each other and are directed to the centre of the rotary 1. The piston and cylinders 5, 6 and 7 comprise static pistons 8, 9 and 10 each provided with a piston head 11, 12 and 13. Cylinders 14, 15 and 16 are slidable along said piston heads 11, 12 and 13 towards and away from the centre of the rotary 1. Sealing rings 17, 18 and 19 are provided in the piston heads 11, 12 and 13 between the piston heads 11, 12 and 13 and the cylinders 14, 15 and 16.

Cylinders 14, 15 and 16 are provided with jaws 20, 21 and 22 for engaging with the upset of a drill pipe. The jaws 20 and 21 are located in corresponding dovetail slots 23 and 24. The cylinder 16 is shown provided with an extension member 25 between the cylinder 16 and the jaws 22. The extension member 25 is located in dovetail slots 26 and the gripping elements 22 are located in corresponding dovetail slots 27 in the extension member 25. In use, either all of the cylinders 14, 15 and 16 are provided with extension members 25 or none of the cylinders 14, 15 and 16 are provided with extension members 25.

Hydraulic lines 28, 29 and 30 and hydraulic lines 31, 32 and 33 are arranged in each piston 8, 9 and 10 for the provision of hydraulic fluid in front of and behind the piston heads 11, 12 and 13.

A quick release pneumatic fluid supply connection 38, an accumulator switch 39 and two release switches 40 and 41 are arranged on the housing 2.

The quick release pneumatic fluid supply connection 38 is slidably arranged in a slot 42 in the housing 2. The slot 42 is shaped to be concentric with the perimeter of the rotary 1. This allows the rotary 1 to rotate a few degrees with a pneumatic fluid supply line attached.

The release switches 40 and 41 are arranged on opposite sides of the rotary so that, when release of the gripping elements 20, 21 and 22 from the drill pipe is required, at least one will be within easy reach of an operator. In particular, in use, part of the stator of the drill pipe tong (not shown) may obscure use of one of the release switches.

Referring now to FIG. 2 there is shown a circuit which is generally identified by reference numeral 100 arranged in and on the housing 2 of the rotary 1.

The circuit 100 is provided with a quick release pneumatic fluid connection 38 slidably arranged in slot 42 of the housing 2 of the rotary 1. The pneumatic fluid is supplied from a source 101 via hose 102, through a valve 103 and through hose 104 to the connection 38. The source supplies pneumatic fluid at approximately 10 bar. A pneumatic line 105 in the housing 2 divides into two branch lines 106 and 107 supplying a pneumatic pump 108 and a bellows 109 respectively. Pneumatic line 107 comprises an valve 110 which is biased by spring 111 to an open position to allow pneumatic fluid to flow to bellows 109.

The circuit 100 is charged while the drill pipe tong is situated away from the drill pipe. This step is carried out by moving the valve 103 to an open position to allow pneumatic fluid to flow from source 101 through pneumatic line 105 and by depressing accumulator switch 39. With the accumulator switch 39 depressed, branch line 10 is blocked. Pneumatic fluid actuates pneumatic pump 108, which pumps hydraulic fluid around a sealed circuit 112.

Hydraulic fluid drawn through line 116 and 117 from the bellows 109 is pumped through line 118, through a check valve 120 into an accumulator 121. A line 119 leads from the rear of check valve 120 to a rear side of spring loaded check valve 122. The spring loaded check valve 122 is biased towards a closed position by a spring 123. A control line 124 leads from a rear side of the spring loaded check valve 122, in parallel with spring 123.

Since accumulator switch 39 is depressed hydraulic fluid is prevented from being pumped through line 113 by the valve 114 being in a closed position.

Hydraulic fluid is prevented from being pumped through a control line 124 by release valves 40, 41 which are closed and by a check valve 125. Hydraulic fluid is also prevented from being pumped through control line 126 by the check valve 125.

The check valves 120 and 125 inhibit high pressure hydraulic fluid escaping from the accumulator 121.

Control line 126 leads from a front side of the check valve 125 to the rear side of a spring loaded check valve 127 in parallel with a spring 128 which bias the spring loaded check valve 127 to a closed position.

Pneumatic fluid 129 in the accumulator 121 is compressed by the pneumatic pump 108 to approximately 280 bar. The pump 108 is prevented from overloading the accumulator by being designed to stall at 280 bar or by use of a pressure relief valve (not shown). The supply of pneumatic fluid is stopped by closing the valve 103. The accumulator switch 39 is now released.

The drill pipe tong can now be offered up to the drill pipe (not shown). The drill pipe is located between the jaws 20, 21 and 22 of the rotary 1 through the opening 4.

The jaws 20, 21 and 22 are activated to engage the upset of the drill pipe by opening the valve 103. Pneumatic fluid flows through the valve 103, through line 105 into line 106 and drives the pump 108 and also through line 107 to one side of a membrane 130 in bellows 109, squeezing hydraulic fluid to the cylinders 14, 15 and 16 at a high flow rate. Hydraulic fluid pressure acting against spring 128 of the spring loaded check valve 127 opens the spring loaded check valve 127. A small amount of hydraulic fluid is allowed to seep from line 126 past the ball of the spring loaded check valve 122 as it opens.

The pump 108 pumps hydraulic fluid into line 113 through valve 114 into line 131, through a check valve 132 and into the cylinders 14, 15 and 16 via branch lines 133, 134 and 135. The pump 108 draws hydraulic fluid from the bellows 109 and from behind the piston heads 11, 12 and 13 through lines 136, 137 and 138, through device 139, through lines 141, 142 into line 140 and through line 143 into line 144 via a flow diverter 145, into line 116 into pump 108. The jaws 20, 21 and 22 engage the pipe. The pump 108 will stall or is stopped by removing the pneumatic fluid once the desired engaging force has been reached. This is typically when the pressure in the circuit 100 has built up to 280 bar.

It should be noted that, during this procedure, the accumulator 121 is simultaneously brought up to the same pressure as the engaging pressure if it does not already retain a pressure equal to or higher than the engaging pressure.

The flow diverter 145 is biased to allow fluid communication between lines 143 and 144. The device 140 comprises three rotors 146, 147 and 148 arranged on a common shaft 149. When hydraulic fluid flows through the rotors 146, 147 and 148, the rotors allow equal volumes of fluid to pass, thereby ensuring even movement of the jaws 20, 21 and 22 arranged on the cylinders 14, 15 and 16.

The hose 104 may now be disconnected from the connection 38.

The rotary 1 may now be rotated to rotate the drill pipe to connect drill pipe.

Once rotation has ceased, the jaws 20, 21 and 22 are disengaged and retracted from the drill pipe. This is carried out by pressing one or both of the release valves 40, 41. This allows hydraulic fluid to flow from the accumulator 121 through control line 124, through spring loaded check valve 122 and through release valves 40 and/or 41 into line 115, line 116 and line 117 to bellows 109. A small amount of hydraulic fluid is allowed to seep past the ball of the spring loaded check valve 122. Hydraulic fluid under pressure also flows from control line 126, allowing pressurised hydraulic fluid to flow from infront of the piston heads 11, 12 and 13 to bellows 109. High pressure hydraulic fluid shifts flow diverter 145 allowing high pressure hydraulic fluid to flow into line 143. The flow through line 143 rotates the rotor 147, which rotatably drives rotors 146 and 148 via shaft 149 and sucks hydraulic fluid out of bellows 109 into the cylinders behind the piston heads 11, 12 and 13 and retracts the jaws 20, 21 and 22 in unison. A valve 150 is arranged in parallel with line 143 and bypasses the device 139. The valve 150 is biased by a spring 151 to a closed position, however upon the pressure increasing on the rear side of the piston head 12, the valve 150 opens equalling the flow rate between the driving rotor 147 and the driven rotors 146 and 148.

The hydraulic fluid in front of the piston heads 11, 12 and 13 is expelled through branch lines 133, 134 and 135 into line 131*a* and passes through spring loaded check valve 128 into line 117 and into bellows 109. The residual hydraulic fluid due to the difference in volumes of the cylinders 14, 15 and 16 when engaged and retracted, flows is stored in the bellows 109. Restrictors 152 and 153 inhibit sudden changes in pressure upon depression of the release valve 40, 41 and the opening of spring loaded check valve 122.

A safety release valve 155 is provided such that if pressure in the accumulator 121 needs to be released the safety valve can be operated to vent the hydraulic fluid to atmosphere or into a safety release accumulator 156. The safety release valve may be operated by a control or be a removable cap in a block 200.

The valves 120, 122, 125, 127, 132, 145, 155 and the respective lines and control lines are arranged in a single block 200. The block 200 may be formed from any suitable material such as aluminium, aluminium alloy or steel.

It should be noted that the entire circuit 100 is arranged in or/and on the rotary 1. The pneumatic fluid source 101 is of the type provided on most drilling rigs and is typically at a pressure of 10 bar.

Various modifications are envisaged to the above apparatus. In particular, it is envisaged that a further accumulator could be provided for providing a charge for moving the jaws into engagement with a pipe. This has the advantage that the pneumatic fluid line may be removed from the drill pipe tong before the drill pipe tong is moved about the pipe thus saving vital seconds disconnecting the hose from the rotary.

It is also envisaged that the apparatus could be used with thin walled pipe, as it is relatively simple to alter the force applied to the pipe by the jaws.

It is also envisaged that the accumulator could take the form of a spring or a battery

What is claimed is:

1. An apparatus for facilitating the connection of pipes which apparatus comprises:

a rotary having an open, radially extending passageway to facilitate the passage of a pipe into the centre of said rotary; and a set of active jaws, characterized in that said jaws are actuable by a single pressurization step, and by a device to help ensure that said jaws move in unison.

2. An apparatus as claimed in claim 1, wherein each of said jaws is mounted on the cylinder of a respective piston and cylinder.

3. An apparatus as claimed in claim 2, wherein the cylinders of at least two piston and cylinders move towards said pipe to engage therewith.

4. An apparatus as claimed in claim 3, wherein each of said cylinders comprises a curved end to substantially conform to said pipe.

5. An apparatus as claimed in claim 1, wherein said jaws further comprising pipe engaging inserts.

6. An apparatus as claimed in claim 5, wherein said pipe engaging inserts are angled to be normal to said pipe.

7. An apparatus as claimed in claim 5, wherein said pipe engaging inserts are those sold by the applicants under the Trade Mark MICRO-GRIP.

8. An apparatus as claimed in claim 2, further comprising extension members for extending the reach of said piston and cylinders.

9. An apparatus as claimed in claim 2, comprising three piston and cylinders.

10. A power tong incorporating an apparatus as claimed in claim 1.

11. An apparatus for facilitating the connection of two pipes, comprising:

a rotary having a radially extending passageway to facilitate the entry of a pipe;

at least two jaws disposed in the rotary for contacting the pipe, wherein each of the jaws contacting the pipe are radially movable toward the center of said rotary;

a device for moving the at least two jaws in unison; and a rotor for each of the at least two jaws and a common shaft to which said rotors are fixed.

12. The apparatus of claim 11, wherein each of the at least two jaws are disposed on a respective piston and cylinder assembly.

13. The apparatus of claim 12, wherein the cylinders of each of the piston and cylinders assembly move towards said pipe to engage therewith.

14. The apparatus of claim 13, wherein each of said cylinders comprise a curved end to substantially conform to said pipe.

15. The apparatus of claim 11, wherein the at least two jaws further comprise pipe engaging inserts.

16. A method for connecting two tubulars, comprising:

placing a first tubular in an opening of a rotary, the rotary having at least two jaws for contacting the first tubular;

actuating the at least two jaws with a single pressurization step;

contacting the first tubular with the at least two jaws, wherein each of the jaws contacting the first tubular is radially movable;

rotating the first tubular to a predetermined torque; and disengaging the at least two jaws.

17. The method of claim 16, wherein the at least two jaws are moved in unison.

18. The method of claim 17, wherein the at least two jaws are moved in unison using a device comprising a rotor for each of the at least two jaws and a common shaft to which said rotors are fixed.

19. The method of claim 16, wherein each of the at least two jaws are disposed on a respective piston and cylinder assembly.

20. The method of claim 19, wherein the cylinders of each of the piston and cylinders assembly move towards said pipe to engage therewith.

21. An apparatus for facilitating the connection of pipes which apparatus comprises:

a rotary having an open, radially extending passageway to facilitate the passage of a pipe into the centre of said rotary; and a set of active jaws, characterized in that said jaws are actuable by a single pressurization step, and by a device to help ensure that said jaws move in unison, wherein said device comprises a rotor for each of said jaws and a common shaft to which said rotors are fixed.

* * * * *